United States Patent [19]

Cremer et al.

[11] Patent Number: 5,042,215

[45] Date of Patent: Aug. 27, 1991

[54] NATURAL STONE ELEMENT FOR LINING FACADES OF BUILDINGS

[75] Inventors: Gottfried Cremer, Cologne; Martin Bard, Amberg, both of Fed. Rep. of Germany

[73] Assignee: Buchtal Gesellschaft mit beschrankter Haftung, Fed. Rep. of Germany

[21] Appl. No.: 307,784

[22] Filed: Feb. 7, 1989

[30] Foreign Application Priority Data

Feb. 8, 1988 [DE] Fed. Rep. of Germany ..... 3803739

[51] Int. Cl.[5] ..... E04B 2/88; E04B 1/16

[52] U.S. Cl. ..... 52/509; 52/378; 52/235

[58] Field of Search ..... 52/156, 157, 235, 508–509, 52/612, 390, 391

[56] References Cited

U.S. PATENT DOCUMENTS

| | | | |
|---|---|---|---|
| 3,248,257 | 4/1966 | Cadotte et al. | 52/612 |
| 3,248,836 | 5/1966 | Monk et al. | 52/235 |
| 3,724,152 | 4/1973 | Castellarin | 52/391 |
| 3,888,055 | 6/1975 | Gallo | 52/136 |
| 3,958,384 | 5/1976 | Megumi | 52/612 |
| 4,060,951 | 12/1977 | Gere | 52/235 |
| 4,640,850 | 2/1987 | Marocco | 52/612 |
| 4,644,711 | 2/1987 | Eickhof | 52/136 |
| 4,931,331 | 6/1990 | Owens | 52/391 |

*Primary Examiner*—Richard E. Chilcot, Jr.
*Assistant Examiner*—Michele A. Van Patten
*Attorney, Agent, or Firm*—Reese Taylor

[57] ABSTRACT

In the case of a natural stone element for lining facades of buildings, the suspension of the stone plate is effected via a ceramic tile glued to the back of the stone plate.

9 Claims, 2 Drawing Sheets

Figure 1:
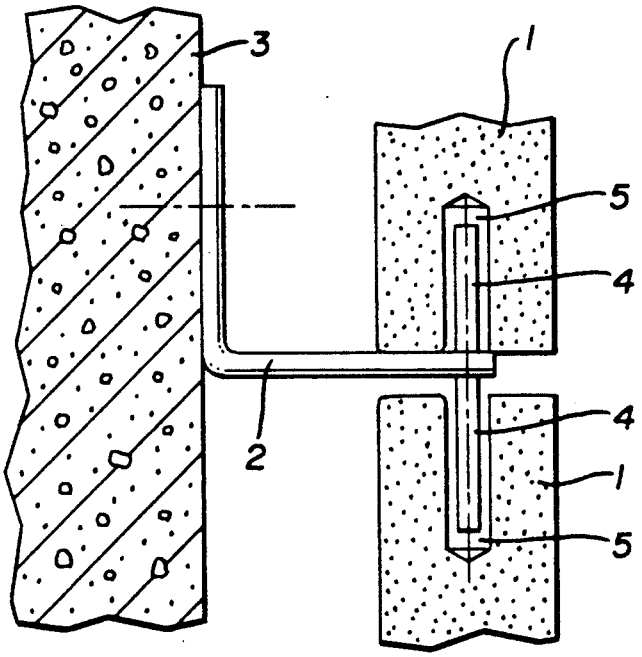
FIG. 1 PRIOR ART

FIG. 2
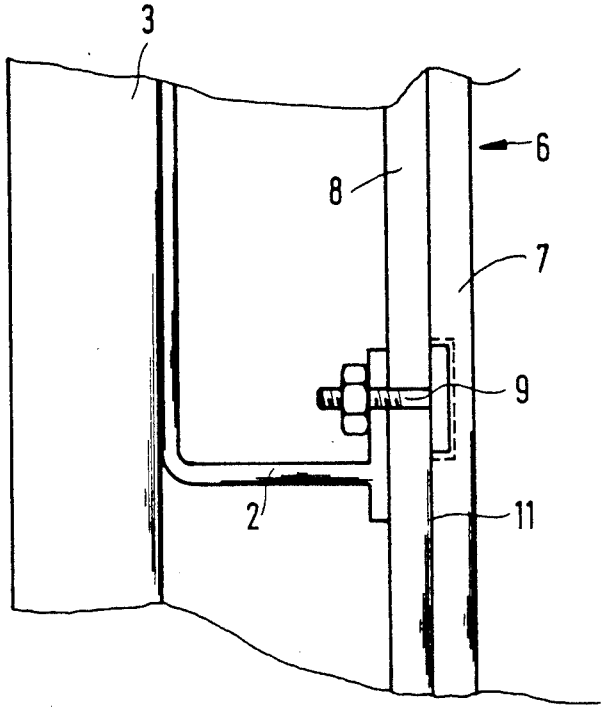
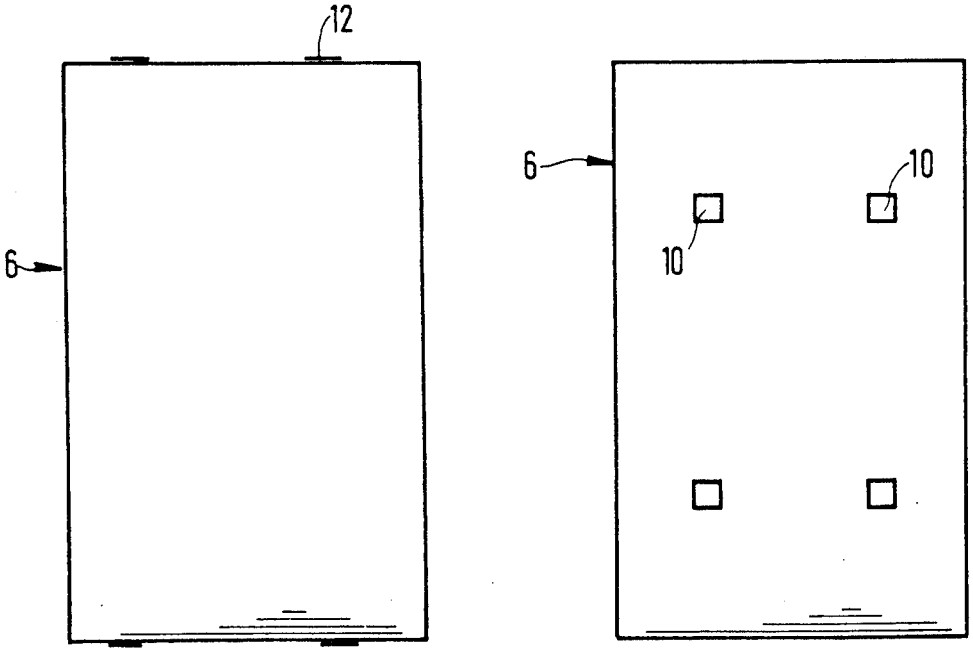
FIG. 6

NATURAL STONE ELEMENT FOR LINING FACADES OF BUILDINGS

RELATED PATENT APPLICATIONS

This application claims priority under 35 U.S.C. 119 based on Federal Republic of Germany Application P 38 03 739.4, filed Feb. 8, 1988.

BACKGROUND OF THE INVENTION

The present invention relates to a natural stone element in the form of a large-format plate for lining facades of buildings.

It is known to divide natural stone, in particular marble, into plate-shaped portions and to use these stone plates for lining facedes or inside walls of buildings.

Such plates are generally attached to the building with the aid of cliplike mounting elements. These clips are connected in an appropriate way with the supporting structure of the building, on the one hand, and hold the stone plate at their edges in the selected position, on the other hand. The clips engage recesses provided for this purpose on the edges of the plates.

The technical requirements for such a facade lining depend on this static edge mounting and the expected wind forces, as well as on the combined effect of dimensions, thickness and weight. They also determine the costs for material and attachment. When very solid natural stone such as marble is used as a facade lining, it does not allow for a wall thickness smaller than 30 mm due to its material structure and its material properties as well as the above-mentioned edge mounting. Since dimensions and wall thickness determine weight, the use of large-format stone plates for facades reaches a technical and financial limit at dimension of approximately 500×1500 mm. This limit becomes more acute the higher the building and the wind load stressing.

For these cases, as well as for applications involving normal requirements, solutions have been proposed for saving weight by joining stone plates with reduced wall thicknesses to thin-walled lightweight supporting plates made of other materials, such as aluminum, platics or the like.

The use of aluminum for forming supporting plates has the advantage that the stone plates, that are basically brittle and very breakable under load, in particular in large formats, are combined with a flexurally strong material that can be used in small wall thicknesses, saves weight and can readily be joined with the stone plate to form a composite plate system. An aluminum plate also provides a great number of possibilities for attaching the large-size plate to the building that are appropriate for the material involved, so that one is free of the disadvantages of edge mounting for natural stone mainly due to the brittleness and lack of flexural strength of this material.

In the case of larger formats, in particular as of one square meter, and use for facades, however, there is a risk of detachment and breakage of the stone plate.

The applicant has found that these disadvantages are mainly due to the fact that the metal supporting plate, when heated, expands much more than the stone plate. The use of shear-resistant adhesives for connecting the aluminum plate to the stone plate allows for some compensation of this difference in expansion, but with larger plates and greater alternating temperature stresses as occur for facades, no lasting success can be achieved with such adhesives, so that this type of composite plate has a limited lifetime.

In the ceramic field, composite tiles are already known (DE-OS 27 45 250) which are intended to reduce the occurrence of temperature expansion stresses and possibly resulting cracks in that the materials of the composite element have approximately the same coefficient of temperature expansion and the adhesive connecting the plate elements has elastic properties. However, in this case the plate forming the visible surface is made of ceramic material and the carrier plate is made of acrylic concrete. To increase the plate stability, one has further suggested providing the back of the acrylic concrete carrier plate with reinforcement ribs running over the edge of the plate and extending obliquely across the back of the plate.

SUMMARY OF THE INVENTION

The invention is based on the problem of providing a large-format natural stone plate with limited weight for facades which can readily be used in spite of the extreme alternating temperature stresses in such cases and is inexpensive to produce.

This problem is solved according to the invention by the features contained in the characterizing part of claim 1.

It has surprisingly turned out that the use of a ceramic tile, in spite of its much higher brittleness and greater weight compared to a metal supporting plate, nevertheless leads to a facade lining that shows no signs of detachment or breakage whatsoever, in particular in large formats and at high alternating temperature stresses. For a stone plate with a format of 1500×500 mm and a wall thickness conforming with the static conditions, this means a weight saving of about 50%. With increasingly large formats, the weight saving that can be obtained is even more favorable for the inventive stone element, since the wall thickness of the stone plate itself must be further increased for static reasons, in particular due to the edge mounting, whereas the dimensions of the inventive stone element can be kept substantially constant. Due to the resulting saving of material and the relatively favorable design of the attachment to the building, considerable costs can be saved for a use of natural stone.

In a most astonishing way, the combination of a stone element with ceramics makes it possible to reduce the thickness even of large-format stone plates to the range of 3 to 4 mm, the thickness of the ceramic tile being in the range of 6 to 8 mm. This results in a considerable weight saving compared to conventional stone plates as facade elements.

Such a stone element is also relatively easy to produce. In spite of the low wall thickness of the stone and the large format, it is possible to produce because of prefabricated stone plate with twice the wall thickness of the stone plate contributing to the compound can be produced in a simple manner, with consideration of the loss of material caused by a subsequent central separating cut on the plane of the plate, by permanently applying supporting plates to both sides of the stone plate with the aid of an adhesive and then performing the separating cut in the stone plate. This results in a non-destructive production even of large-format thin-walled tiles during this production process, since they serve as supporting plates for the separating cut in the stone plate during production as well as for the stone plate when it is suspended on the building facade.

The invention further proposes selecting the stone to be used with consideration of its coefficient of thermal expansion in such a way that the latter corresponds at least approximately to that of the ceramic tile in order to avoid the above-described adverse effects of different coefficients of thermal expansion. The coefficient of thermal expansion is $5\times10^{-6}$ m/m in the material of which the large-format ceramic tiles are made. That of natural stone fluctuates between $1.5\times10^{-6}$ m/m depending on the starting material.

In a development of the inventive idea, metal mounting means are integrated into the composite element. This allows for the mountings to be arranged in accordance with static points of view but remote from the edges, and thus for larger-format composite elements than in the case of conventional edge mounting.

These metal mounting means are integrated in force-locking and/or form-locking fashion, being received either by the ceramic tile in countersunk holes for taking up the screw heads or the like, or by the stone plate in recesses, whereby the ceramic tile has bores of circular cross-section or passages of other cross-sectional shape.

Due to the great importance of the strength and elasticity of the adhesive connecting the stone plate and the ceramic supporting plate in a composite element of the invention type, the adhesive must be specially standardized to ensure high shear resistance, ageing stability and an elastic behavior such that it can accommodate, without fatigue and loss of strength, the movements of the cover and carrying plates occurring due to thermal expansion and tensile or compressive stresses. Modified plastic adhesives are suitable for this purpose. The improve the bond between the adhesive and the stone plate, it is recommendable to roughen the back of this plate. However, to spare the adhesive layer avoidable stresses due to bending loads, one should select the wall thickness of the stone plate such that its rigidity corresponds to that of the ceramic tile. This will make the neutral axis (neutral area), i.e., the area in which non normal tensions act, come to lie on the plane of the composite body filled in by the adhesive in the case of stress on the composite element. One can achieve this by taking account of the influence of the elastic modulus and plate thickness on the bending moment of the plate. To determine the wall thickness of a certain stone material, one assumes a constant elastic modulus for a desired stone material and an elastic modulus and a constant plate thickness for the ceramic supporting plate.

Figure 3:
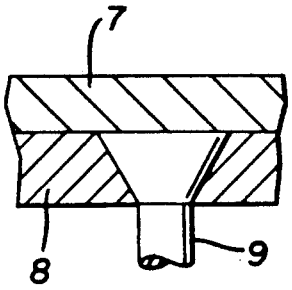
Figure 4:
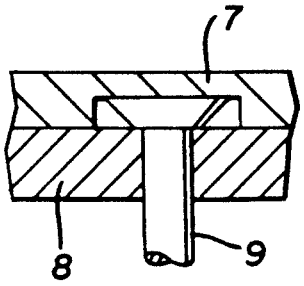
Figure 5:
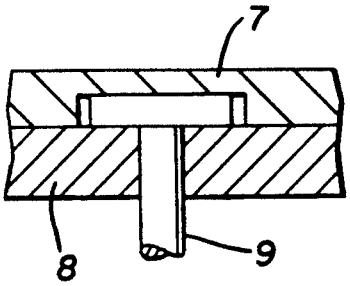

In the following, exemplary embodiments of the invention shall be described with reference to the drawing, in which:

FIG. 1 shows a schematic sectional view of a prior art stone element with conventional suspension, FIG. 2 shows a comparable schematic sectional view of a preferred embodiment of the invention, FIGS. 3 to 5 show details of the mounting means used for suspension, FIG. 6 shows a front view of an embodiment, with a plate with conventional edge clamping on the left and a plate with edge-remote clamping on the right.

BRIEF DESCRIPTION OF THE PREFERRED EMBODIMENTS

According to FIG. 1, the stone plates referred to as 1 are suspended on building structure 3 indirectly via clip-like mounting means 2. The mounting stone plates 1 is effected specifically via clips 2 by means of projecting elements 4 formed on the clips and engaging suitably formed recesses 5 in the stone plates. According to the representation in FIG. 1, two elements 4 projecting on each side are disposed on each clip, upper projecting element 4 engaging a recess 5 worked into the lower edge of upper stone plate 1, and lower projecting element 4 engaging recess 5 provided on the upper edge of lower stone plate 1.

In the embodiment of FIG. 1, stone plates alone are involved, which for static reasons must have a wall thickness of about 3 cm with a format of 1.5 m $\times$0.5 m. Such a plate has a considerable weight, so that the mounting elements for suspending it must have corresponding dimensions.

In the embodiment of FIG. 2, the stone element referred to in general as 6 is formed by a stone plate 7 much narrower than in FIG. 1 and a ceramic tile 8 disposed on the back of stone plate 7 and serving as a supporting plate therefore, and also engaged by the mounting means.

In the embodiment shown, ceramic tile 8 is attached to clip 2 via a plurality of screws, specifically hammer head screws 9, which are attached in the usual way to the building structure referred to as 3.

In the representation of FIG. 2, the hammer head formation of the screw head is received in a suitable recess in stone plate 7.

In the representation of FIG. 3, a countersunk head screw is used which is received in an accordingly conical opening in ceramic tile 8.

In the embodiment of FIG. 4, a hammer head screw 9 is again used whose head is received in a suitable recess in stone plate 7. In this embodiment, the bore provided for hammer head screw 9 is formed with a circular cross-section in ceramic tile 8. In the embodiment of FIG. 5 describing a comparable hammer head screw 9, however, the bore cross-section is rectangular or of some other non-circular shape so as to ensure a force-locking seat of the screw.

FIG. 2 indicates the edge-remote arrangement or engagement of the mounting means on the ceramic tile. This is illustrated more specifically in FIG. 6 which shows schematically, on the left, an edge arrangement of the mounting means at 12 and, on the right, the edge-remote arrangement of the mounting means at 10.

The bond between the ceramic tile and the stone plate is brought about by a suitable adhesive which is referred to as 11 in FIG. 2 and disposed between the adjacent surfaces of the two plates. A suitable adhesive is in particular a solventless, dual component epoxy resin adhesive, which may be cold-or hot-setting.

The thickness of the stone plate may be 10 mm and less. Thicknesses of 3 to 4 mm are readily possible. The thickness of the ceramic tile is expediently 6 to 8 mm.

In a preferred embodiment, the stone plate has a format of 1.5 m$\times$0.5 m and a thickness of 3 or 4 mm. The stone plate is glued to a ceramic tile with a thickness of 8 mm, using a dual component epoxy resin adhesive which is slighly thixotropic.

What is claimed is:

1. A lined building facade comprising:

a stone plate;

a ceramic supporting plate;

said supporting plate having a coefficient of thermal expansion approximately equal to that of said stone plate;

means for affixing said supporting plate to said stone plate such that said supporting plate and said stone plate form an element;

said means for affixing said supporting plate to said stone plate includes an adhesive;

mounting means for mounting said element onto the building including clip means in supporting communication with said element; and said supporting communication being effected through bores in said ceramic supporting plate and recesses in said stone plate.

2. A lined building facade as in any of the preceding claims, wherein said adhesive is an epoxy resin.

3. A lined building facade as in claim 2, wherein said supporting plate has a rigidity substantially equal to that of said stone plate.

4. A lined building facade as in claim 1, wherein said supporting plate has a rigidity substantially equal to that of said stone plate.

5. A lined building facade as in claim 1, wherein said stone plate has a roughened side facing said supporting plate and to which said supporting plate is affixed.

6. A lined building facade as in claim 1, wherein said stone plate is less than about 8 mm thick.

7. A lined building facade as in claim 6, wherein said stone plate is from about 3 to about 4 mm thick.

8. A lined building facade as in claim 6, wherein said stone plate has a format of about 1500 by about 500 mm.

9. A lined building facade as in claim 1, wherein said ceramic tile is from about 6 to about 8 mm thick.

* * * * *

UNITED STATES PATENT AND TRADEMARK OFFICE

CERTIFICATE OF CORRECTION

PATENT NO. : 5,042,215

DATED : August 27, 1991

INVENTOR(S) : Gottfried Cremer et al.

It is certified that error appears in the above-identified patent and that said Letters Patent is hereby corrected as shown below:

Column 1, line 43, delete "platics" and substitute therefor --plastics--.

Column 2, line 55, delete "of" and substitute therefor --a--.

Column 3, line 9, immediately following "1.5 X $10^{-6}$" insert the following --and 8.2 X $10^{-6}$--.

Column 3, line 33, delete "The" and substitute therefor --To--.

Column 3, line 40, delete "non" and substitute therefor --no--.

Column 4, line 20, delete "therefore" and substitute therefor --therefor--.

Signed and Sealed this

Sixth Day of October, 1992

*Attest:*

DOUGLAS B. COMER

*Attesting Officer*

*Acting Commissioner of Patents and Trademarks*